US005457827A

United States Patent [19]

Johnson

[11] Patent Number: 5,457,827

[45] Date of Patent: Oct. 17, 1995

[54] SOAP SADDLE

[76] Inventor: Joe C. Johnson, Box 37, Mountain Park, N.M. 88325

[21] Appl. No.: 301,301

[22] Filed: Sep. 6, 1994

Related U.S. Application Data

[63] Continuation-in-part of Ser. No. 155,683, Nov. 22, 1993, abandoned.

[51] Int. Cl.[6] ..... A47K 5/02

[52] U.S. Cl. ..... 4/628; 4/605; 4/661; 206/77.1; 248/309.1

[58] Field of Search ..... 4/628, 657, 661, 4/605; 206/77.1; 248/214, 309.1; D6/529, 532, 536, 540, 545

[56] References Cited

U.S. PATENT DOCUMENTS

| | | | |
|---|---|---|---|
| D. 193,607 | 9/1962 | Ebbert | D6/536 |
| D. 351,304 | 10/1994 | Glass | D6/536 |
| 412,499 | 10/1889 | Hamilton | 4/628 |
| 2,094,841 | 10/1937 | Groeniger | 4/628 |
| 3,775,779 | 12/1973 | Kohler | 4/628 |
| 4,530,479 | 7/1985 | Chen | 248/309.1 |
| 5,114,108 | 5/1992 | Olschansky | 248/214 |
| 5,181,621 | 1/1993 | Plaehn | 248/309.1 |
| 5,275,363 | 1/1994 | Dennis | 248/214 |

FOREIGN PATENT DOCUMENTS

| | | | |
|---|---|---|---|
| 2604885 | 4/1988 | France | D6/532 |

*Primary Examiner*—Henry J. Recla
*Assistant Examiner*—Gregory M. Vidovich

[57] ABSTRACT

A bar soap receptacle composed of one element, culminating in a multiple purpose platform; having propitious draining placement features, bar soap enhance drying features, and an aesthetically pleasing likeness of a horse's saddle.

1 Claim, 3 Drawing Sheets

SOAP SADDLE

This is a continuation in part of application Ser. No. 08/155,683, filed 22 Nov. 1993, now abandoned.

BACKGROUND OF INVENTION

This invention pertains in general to the art of Kitchen utensils and more particularly as a novel soap receptacle for use about the kitchen sink. In a stable configuration within the sink's sphere, but placed in a general disposition to afford propitious dripping residue from the soap to enter the sink's main bowl drainage.

The necessity at the kitchen sink, bathroom sink, and the laundry sink is to have a bar soap holder that predisposes the bar soap to ease of access, while reducing the accumulation to the soap holder of soap sludge effluent. A soap holder that maximizes ambient air circulation to the bar soap, with the expectations of keeping the bar soap as dry as possible.

PRIOR ART CITED

U.S. Pat. No. 1,604,121, representing soap dishes, have good placement of devices, but are wholly lacking in good drainage and aeration.

U.S. Pat. No. 2,094,841, while this device has good placement, it has very poor soap affluent drainage, a multiplicity of soap sludge fouling venues, and poor air drying access to the bar soap.

U.S. Pat. No. 412,499, this soap dish secures to the outside of bucket or on wall, necessitating placement of another device under it for proper disposal of bar soap affluent, air drying access to the bar soap is hampered by solid raised sides and large area drain bars.

U.S. Pat. No. 4,548,572, though limited to bath shower stalls provides some drainage and some aeration, as a soap saver.

U.S. Pat. No. 5,255,401, as a shower caddy is an improvement over prior art, provides little aeration and poor soap sludge run off clearing the device.

U.S. Pat. No. 4,993,546, while this device provides some lift above watery soap sludge, its own attached tool device must be employed to clear away the sludge build up. Aeration yet remains excessively encumbered.

U.S. Pat. No. 5,181,606, while an improvement over prior art is yet to unwielding a design, sludge run off (clearing the soap dish) is impaired by sloping trough, thusly making cleaning difficult, interior sludge effluent stoppage probable.

U.S. Pat. No. 5,253,752, has no ambient air drying facilitation to the soap bar. The v-shaped protuberances 31 and downward sloping of the device would impede soapy sludge run off, while the soap bar could just as effectively wedge into its constricted opening 41, thereby further impeding soapy sludge drainage.

Most plumbers (as common knowledge) know that a straight away drop keeps the drain path free of clogging (sewage) sludge build up.

U.S. Pat. No. 193,607, though it allows for cross ventilation of air to the soap bar, draft air ventilation access is nullified as a dish is required underneath it to catch soap affluent, and soap sludge would build up on broad flat areas of the drain bars.

U.S. Pat. No. 3,775,779, as pertaining to its soap dish has relatively no air ventilation to the soap bar and does not drain away soap sludge from close proximity to bar soap.

U.S. Pat. No. 4,530,479, as a soap receptacle has poor placement for soap affluent drainage and cumbersome, if not downright hazardous (bar members 22) bar soap retrieval.

U.S. Pat. No. Des. 351,304, while it is a soap dish, it has no drainage, little air ventilation, and retains the bar soap's affluent sludge.

Mauhourat FR 2604,885, this soap holder secures only onto a wall, it has poor affluent drainage as large flattened drain bars would tend to hold soap sludge up against bar soap, thus impeding draft air drying access to bar soap. A dish must be placed under it to catch what soap affluent that does escape the holder.

U.S. Pat. Nos. 5,114,108 and 5,275,363, while they are clever devices, are clearly not intended nor designed for bar soap receptacle applications, and for soap use, would be greatly ineffective.

As evidenced by this recital, there has yet remained a need for an improved soap dish, which improves aeration, improves cleaner drainage, and generally improves availability of the soap bar. All this is now available within the frame work of one piece construction in this invention.

SUMMARY

Generally the purpose of this invention, wherever it is used, is to provide a utilitarian repository for the soap bar that reduces the associated mess and handling of said soap.

Another objective of this invention is to place the soap bar in a more favorable arena for soapy affluent residue to drain away.

Another objective of this invention is to facilitate the drying process of the soap bar.

Another objective of this invention is to provide a more aesthetically pleasing repository for the soap bar, thus reminding all who use the facilities, as to were the bar soap's designated resting place is.

A related objective of this invention is to have a soap receptacle easily rinsed off or have the ease of cleaning via the dish washer..

Other advantages and objectives will become apparent in the perusal of the following drawings and specifications.

BRIEF DESCRIPTION OF DRAWINGS

The drawings shown are for the preferred embodiment of a one piece item, the soap saddle, a receptacle for holding soap bar.

DETAIL DESCRIPTION OF PREFERRED EMBODIMENT

In accordance with the invention, the bar soap receptacle is constructed of one molded piece, which incorporates all the facets of it's multiple purpose functions.

The soap saddle is preferably made from cast or thermosetting plastic, preferably via the injection molding process, molded and configured in the general shape of a horse's saddle. A one piece item about the right size for dishwasher cleansing.

Several other representative shapes such as a turtle, a horse, a whale, etc., could lend their general shapes and coloring shades very nicely, for likeness soap receptacles, of this type, in similar matter as the soap saddle, and is within the scope of this invention.

The coloring variation arrangement of the soap saddle, might be mottled in it's coloration, to resemble the color of used leather, thus enhancing it's stain hiding qualities.

Figure 1:
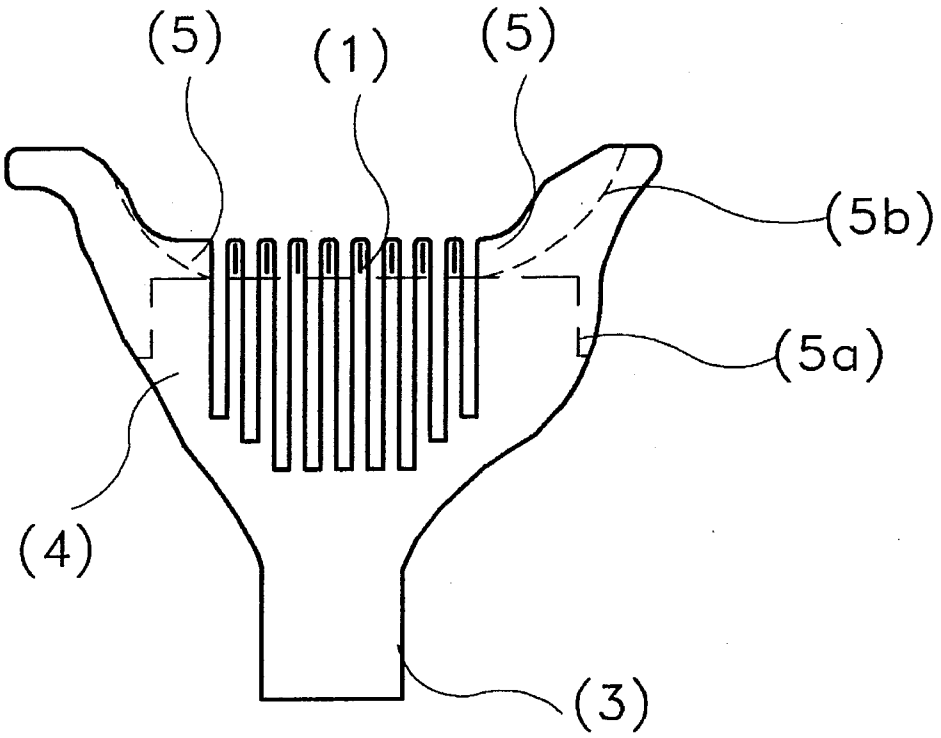
FIG. 1 is the side view of soap saddle.

Soap saddle as shown in FIG. 1, shows the vertical drain bars (1) that provides, for sludge effluent drainage access for supporting and restraining a bar of soap placed thereon.

Figure 3:
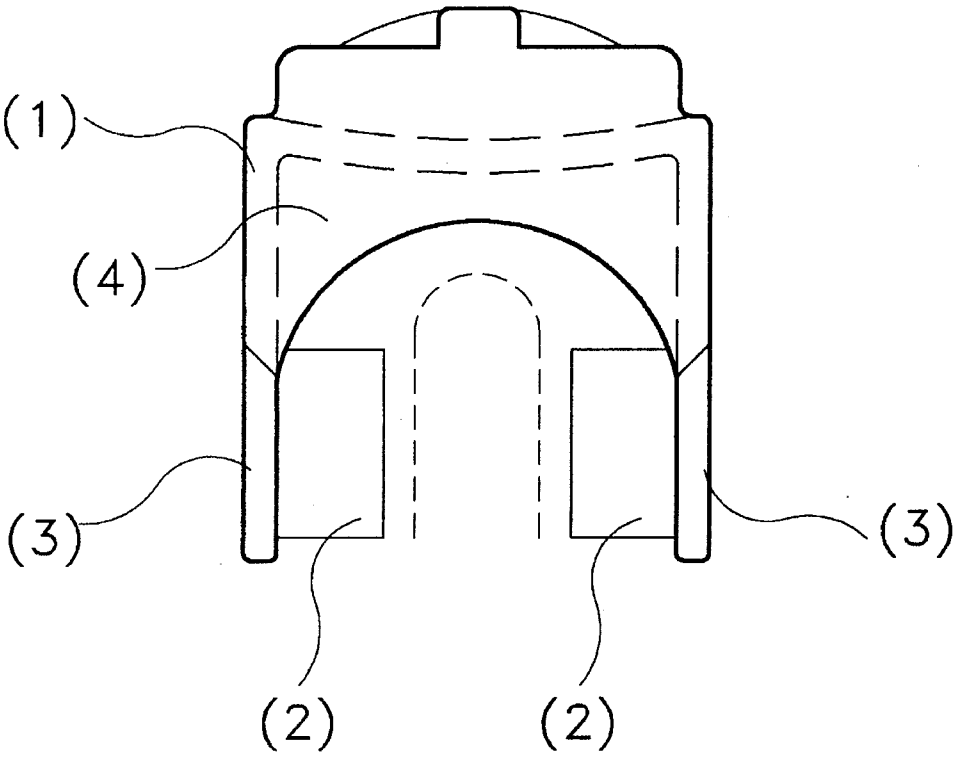
FIG. 3 is the front view of soap saddle.

The vertical drain bars (1), as shown in FIG. 1 and FIG. 3, are attached to the soap saddle's side (near) in the fender-stirrup areas (3), at the two bottom ends of their inverted U-shape.

In FIG. 1, the larger broken lines show general upper parameters of open or hollow underside area (4) of soap saddle. This inner-underside of soap saddle has molded shaping similar to the saddle which slips over a horse's back.

In FIG. 1 the smaller broken lines (**5*b***), indicate recessed areas, normally hidden from this view, which enhance effluent drainage access, soap aeration access, and finger access to bar soap.

Bars (1) as shown in FIG. 3, front to back, normally hidden from frontal view, the vertical drain bars (large broken lines) are slightly concaved to cradle the soap bar. But might just as effectively by fitting application be shaped (as they form the top of the saddle's seat rest area), in a straight manner, a concaved fashion, or in a wavy form.

There is a sloping drainage, as shown (in FIGS. 3 and 5) by a short line of appox. 45 degrees, between the base attachments ends of the vertical portions of the drain bars (1) in the fender-stirrup areas.

The vertical drain bars (1) are molded into an inverted U-shape up both sides and over the top and across the saddle's seat rest area. The inverted U shape provides clearer soap sludge effluent access drainage, with minimal area for clinging of soap sludge effluent, allowing said sludge to drain easier into the main appliance basin, and as means providing for draft air circulation and cross ventilation of air movement access to the soap bar.

The vertical drain bars (1) of soap saddle, has preferred dimensions of ⅛ of an inch in thickness, by ¼ of an inch wide, by 1¼ inches up the saddle's sides in height and length across the saddle's seat (front to back as shown in drawing of FIG. 1), forming in an inverted U-shape configuration, with the preferred spacing in between themselves of ⅛ of an inch.

The preferred overall dimensions of the soap saddle, are 2½ inches in width, by 3 inches in height, by 3½ inches in length, preferably constructed of plastic.

The plastic construction follows a horse's saddle's general shape contour, wherein the main body of the saddle has its construction of plastic thicknesses more or less varying from ⅛ of an inch to ¼ of an inch. The bottom underside is hollowed out (4) for improved drainage and aeration.

The multiple fins (2), are the adaptable gripping devices for holding the soap saddle onto various sink or basin structures; such as the sink's median or partition, the sink or basin water faucet spouts or any other suitable appendage were a bar soap receptacle might be needed.

Figure 5:
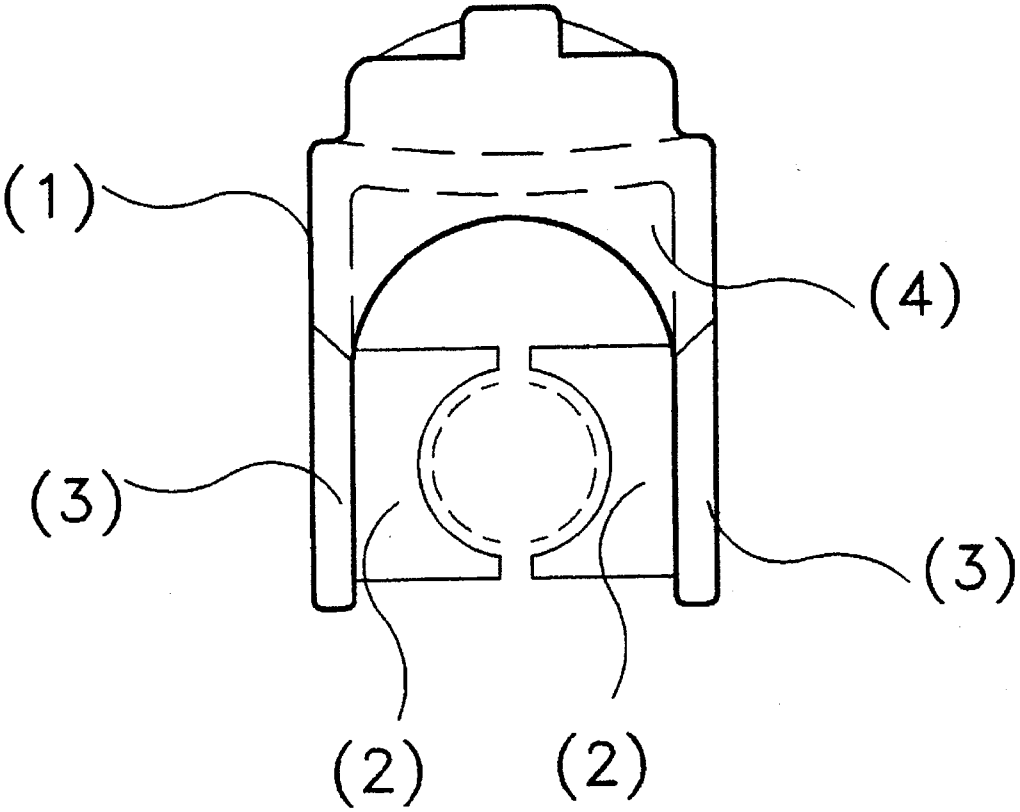
FIG. 5 is the front view of soap saddle (option), showing the fitting arrangement for faucet spout, sized down for appropriate placement.

Smaller broken lines in between multiple fins (2) in FIG. 3 and FIG. 5 indicate an object to be gripped.

The multiple fins (2) are flexible in nature and as such are adaptable to various widths and contours of sink partitions, water spouts, or other suitable appendage.

Figure 4:
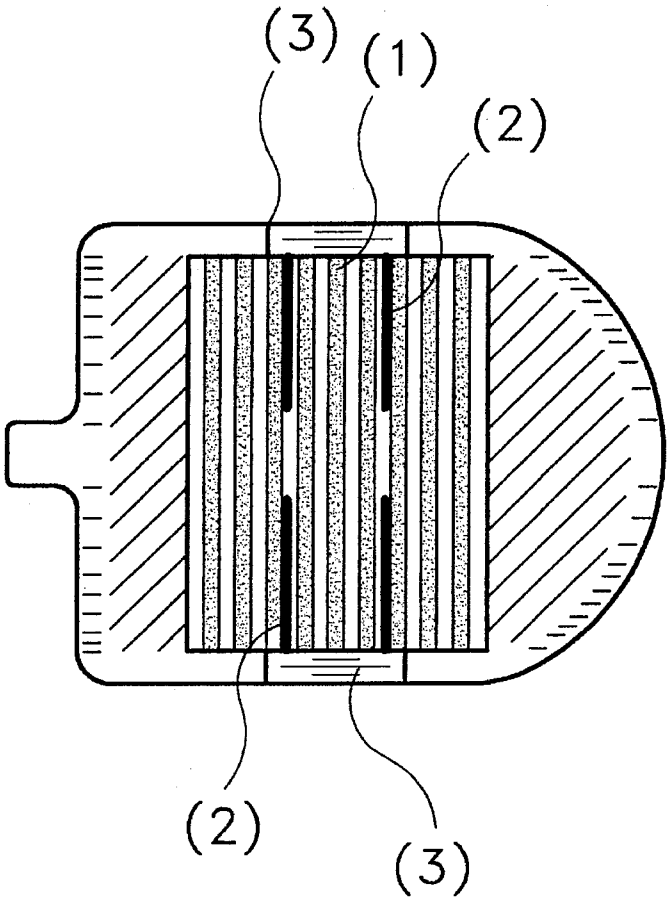
FIG. 4 is the bottom view of soap saddle.

The multiple fins (2) preferred size are 1/16 of an inch in thickness, by ¾ of an inch wide, by 1 inch in height as shown in FIG. 3 and FIG. 4.

The unseen areas of the soap saddle's bulk, as shown in the drawings, is molded with open or hollow cavity(4), allowing for greater air circulation under the insides of said soap saddle, which general cavity opening occurs across the bottoms of the vertical drain bars as well.

Provision for optional designing which allows for soap saddle to be appropriately sized down or up as the various cases and needs may dictate, for seizing, for gripping a water faucet's spout, or for accommodating larger widths of sink's median or partition.

Figure 2:
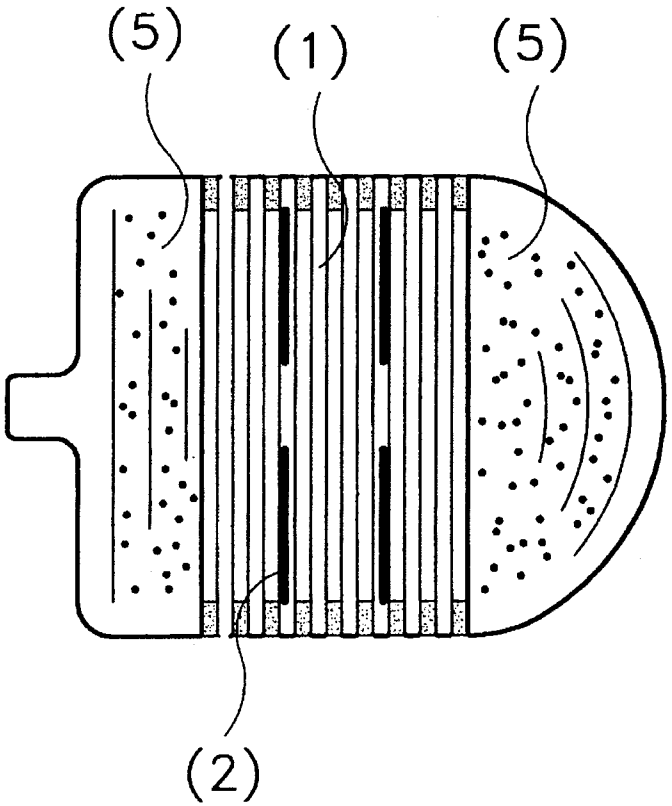
FIG. 2 is the top view of soap saddle.

Soap as shown in FIGS. 3 and 5 shows side views of the fins (2), and as heavy lines in FIGS. 2 and 4 shows end views of the multiple fins (2) incorporated on the inside of both stirrup areas (3). They are of a flexible nature and flex to enthrone or snugly grip and straddle the sinks median or partition, or the water faucet's spout, (which implies the adjustable character of the fins to adapt to the varying manufactured widths of various sink's fixtures).

The soap saddle might find fitting application, wherein it might be constructed without the gripping fins.

In the top back rest or cantle area of the soap saddle's seat, provides a recessed place (5) enhancing the fingers ability to retrieve the soap bar. This area in conjunction with the front top area close to saddle horn and swells (FIG. 3), is a concaved or recessed locations (5), are sloped to facilitate affluent draining in these areas (as depicted by small broken lines (5) in FIG. 1 and by dots (5) in FIG. 2 of drawings), Soap saddle as shown in FIG. 5, shows the sizing option and the alteration which can take place in order to facilitate the invention finding a suitable grip on a sink faucet's spout. The fin's flexible plastic has ease of cutting to form to the various contour shapes of spouts, or gripping without cutting;

Having described my invention I claim:

1. A bar soap receptacle formed from a one piece molded construction, said receptacle comprising:

two end walls each having top peripheral edges;

two side walls each having top peripheral edges;

a top wall having peripheral edges in connection with said top peripheral edges of said end walls and said side walls wherein said receptacle has an open bottom and a hollow interior defined by said end walls, said side walls and a bottom surface of said top wall;

said top wall having an upper surface, a concave shape and an opening centrally located therethrough which encompasses a portion of said peripheral edges of said top surface along the length thereof;

each of said side walls having an opening defined therethrough which encompasses a portion of said top peripheral edge of said side wall, said opening in each of said side walls occupied by a plurality of horizontally spaced vertical drain bars, each of said vertical drain bars having a first end in connection with said side wall and a second end extending vertically therefrom to a point above said upper surface of said top wall wherein said opening of said top wall being centrally located between said side walls intermediate said second ends of said vertical drain bars, each of said plurality of vertical drain bars on one of said side walls being substantially horizontally aligned with one of said plurality of vertical drain bars on the other of said side walls to thereby define a plurality of pairs of vertical drain bars;

a plurality of horizontally spaced horizontal drain bars adapted to support a bar of soap, each of said horizontal drain bars having first and second ends in connection with respective second ends of one of said pairs of vertical drain bars; and means for gripping on object to support said receptacle in a use position, said means for gripping comprising a flexible extension extending downwardly from each of said side walls, said extensions adapted to cooperate with one another for gripping said object therebetween.

* * * * *